United States Patent [19]

Hofsäss

[11] Patent Number: 4,470,033

[45] Date of Patent: Sep. 4, 1984

[54] THERMAL SWITCH

[76] Inventor: Peter Hofsäss, Strietweg 45, 7530 Pforzheim, Fed. Rep. of Germany

[21] Appl. No.: 409,057

[22] Filed: Aug. 18, 1982

[51] Int. Cl.[3] ..... H01H 37/74

[52] U.S. Cl. ..... 337/343; 337/348; 337/365

[58] Field of Search ..... 337/334, 335, 343, 348, 337/365, 370, 372, 380

[56] References Cited

U.S. PATENT DOCUMENTS

| | | | |
|---|---|---|---|
| 2,644,873 | 7/1953 | Vroom et al. | 337/368 |
| 4,117,443 | 9/1978 | Hofsäss | 337/348 |
| 4,325,047 | 4/1982 | Inada et al. | 337/370 |

FOREIGN PATENT DOCUMENTS

| | | | |
|---|---|---|---|
| 1078212 | 9/1957 | Fed. Rep. of Germany | 337/370 |

*Primary Examiner*—George Harris
*Attorney, Agent, or Firm*—Antonelli, Terry & Wands

[57] ABSTRACT

Known thermal switches designed for safeguarding apparatus against overheating have been produced with one driving bimetal snap action disk and a spring snap action disk responsible for the contacting force on the turned-on position of the switch. For operation of the switch the bimetal snap action disks have to be powerful enough for overcoming the full contact-making pressure of the spring snap action disk and to this end it is necessary for the bimetal disk to be made quite large in size or the contact-making forces produced thereby will be so low that the conduction and switching properties are poor.

For taking care of this shortcoming of the prior art in the invention a thermal switch has two formed spring snap action disks acting in opposite directions. This makes possible the use of small bimetal snap action disks which nevertheless give high contact-making forces and troublefree operation of such a thermal switch.

17 Claims, 8 Drawing Figures

FIG. 1
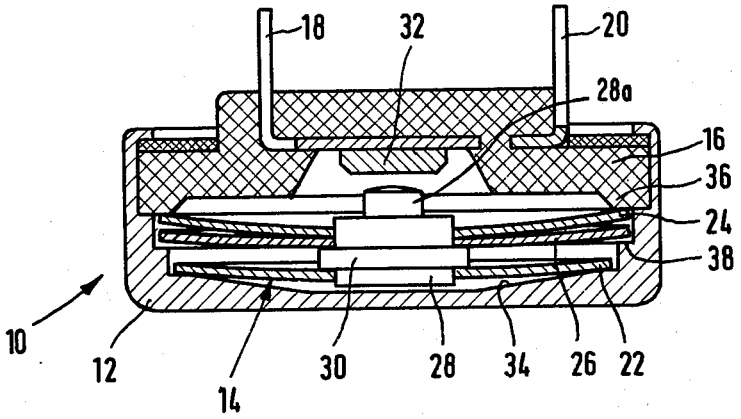
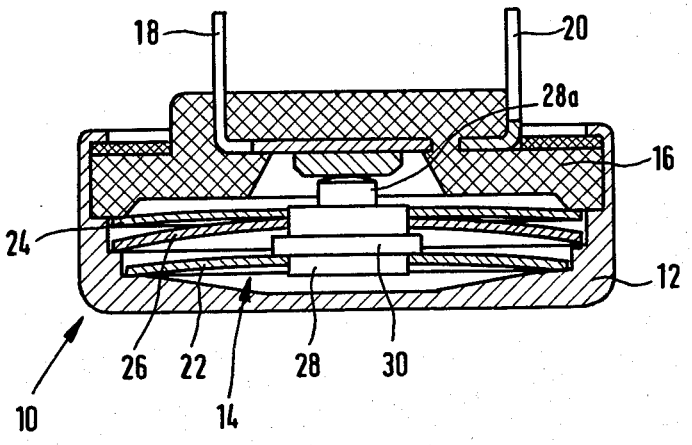
FIG. 2

FIG. 3
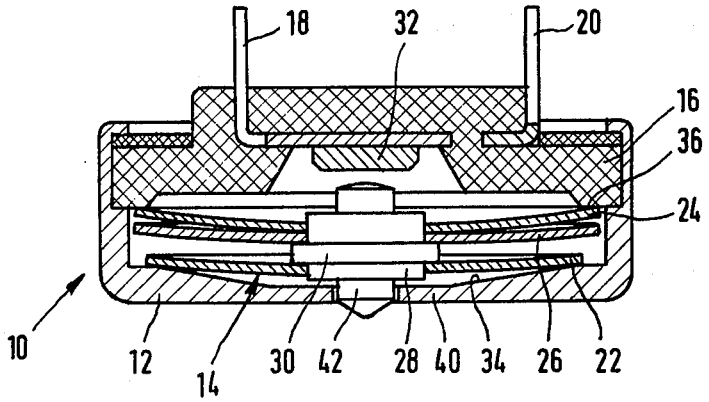
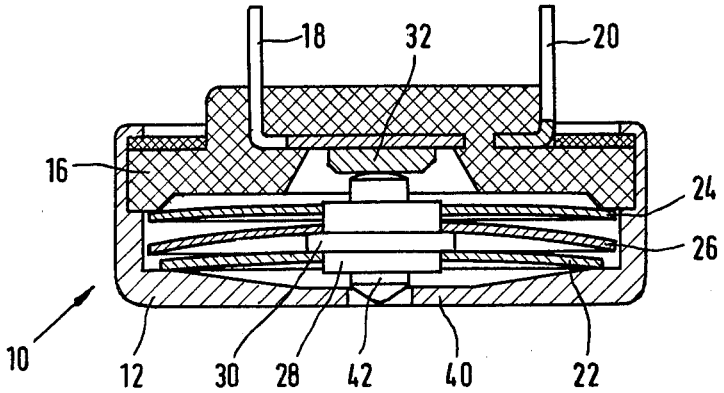
FIG. 4

THERMAL SWITCH

BACKGROUND OF THE INVENTION

The present invention relates to a thermal switch with a bimetal snap disk and at least one spring snap-action disk. The wording "thermal switch" is generally used herein in the sense of a switch joined up with electrical wiring and which has a bimetal disk producing a switching operation at a critical point of temperature change. In the main, such a thermal switch will generally have a temperature-monitoring function, for example as a safeguard against overheating of electrical apparatus.

In the present specification and claims, the wording "spring snap-action disk" is used in the general sense of formed or pre-embossed spring disks with a non-linear displacement-force curve having at least one point of inflection, at which there may or may not be a reversal of the force, the snap-action effect being seen from the fact that after displacement through some distance under an unchanging or (more frequently) slowly increasing bending force, the speed of bending is at first slow or even goes down as far as a force-displacement (or force-motion) maximum, at which there is a sharp increase in the speed, that is to say there is a snap-action, because the stiffness of the spring snap-action disk becomes less.

An account of one form of such a switch is to be seen in German Pat. No. 2,121,802 and further examples of such switches are to be seen in German Offenlegungsschrift specifications Nos. 2,917,557 and 2,916,664. In a further design, see German Offenlegungsschrift specification No. 2,522,214, wherein two such switches are placed in a single housing, with the one switch functioning as a temperature regulator and the other switch as a safety switch. A normal design point in connection with these switches is that for producing the contact pressure in the switched-on position and for conducting the current, a spring snap-action disk is used so that there is a lower load on the bimetal snap-action disk and it is only responsible for producing the switching operation. In the case of this design, more specially on separating the switching contacts, the bimetal snap-action disk has to take up the full contact-making force which is produced by the spring snap-action disk. For producing such a force, it is, for this reason, necessary for the bimetal disk to generally be of large size. However, as part of the general tendency towards miniaturization of electrical components and systems, attempts have to be made at making such thermal switches as small as possible. In the known switches, it is necessary, in this case as well, for the bimetal snap-action disk to be made smaller in size. When this is done, however, it will be less powerful, that is to say less able to undertake mechanical work. For this reason, the spring snap-action disk has to be designed for producing only a low contact pressure, the outcome of this being higher contact resistances. Moreover, a smaller size of bimetal snap-action disk will make for lower switching powers and the working life of the switch (number of switching operations) will be decreased. For lowering the contact resistance, it is generally possible to make use of gold contacts, but, however, they are high in price.

GENERAL OUTLINE OF THE INVENTION

For this reason, one purpose of the present invention is that of designing a thermal switch taking care of the shortcomings noted and, more specially, makes possible higher contact forces or pressures without, generally speaking, any change in size being necessary, or making possible a decrease in the size of the thermal switch, and more specially of the bimetal snap-action disk, while giving the same contact force.

A further purpose or object of the invention is that of designing such a switch which, while smaller in size than standard switches, gives the same contact force, is as trouble-free in operation and has the same switching capacity.

For effecting this purpose, and further purposes, the thermal switch of the invention has two pre-embossed spring snap-action disks placed so as to have opposite effects.

In the case of such a design of thermal switch as part of the invention, the bimetal disk no longer has to overcome the full contact force of the spring snap-action disk responsible therefor and, in fact, only has to overcome the difference between the pressing force with respect to the opposite force of the further spring snap-action disk at the snap-over point of the bimetal disk. The greater contact force or pressure, so made possible without changing the size of the switch makes the new switch even more insensitive towards vibrations so that the switch of the invention may be put to many further uses. The thermal switch of the invention is very trouble-free in operation while having a small size, that is to say while being smaller than switches which have so far been able to be used.

In the invention the spring snap-action disks are placed so as to give opposite effects, this wording being used herein to make it clear that with their domed form the disks are so placed in the thermal switch that their forces produced on being bent out of the resting position are oppositely directed, at least at the snap-over point of the bimetal snap-action disk. Spring snap-action disks may best be so stamped or embossed that there is no change in the direction of their force as they are bent so that, in other words, once the disks have been placed in position so as to be of opposite effect, they will, at all times, be of opposite effect. However, in this case, the resting or starting position of the other spring snap-action disk will be near the one end position of the thermal switch while the resting position of the other spring snap-action disk will be near the other end position of the thermal switch without the spring snap-action disks ever being able to go into their resting position because of the prestresses they have been given in the first place. In the turned-on position of the thermal switch (inasfar as an opposite force is produced by the one spring snap-action disk against the pressing force of the other spring snap-action disk) these stresses will be taken up by the bimetal snap-action disk so that the overall force of the driving spring snap-action disk will be made use of before producing the contact pressure. On a change in temperature past the snap-over point of the bimetal snap-action disk—for example out of the turned-on position noted—the switch will firstly go through a condition in which the bimetal snap-action disk does not make for any force opposite to the first-noted spring snap-action disk so that its force may take effect against the snap-action disk responsible for the contact pressure. The bimetal snap-action disk will then only have to overcome the difference between the two opposite forces of the two spring snap-action disks for causing a switching cycle of the thermal switch. After switching, the two oppositely acting forces of the spring snap-action disks in the turned-off position of the thermal switch will have the effect of generally balancing each other at a low force level. For switching back the switch, the bimetal disk only has to be responsible for a small force for putting an end to the on-balance condition and causing switching of the thermal switch back into the turned-on position.

As part of one working example of the thermal switch of the invention, the bimetal snap-action disk may have its active side, that is to say the side undergoing a greater thermal expansion with an increase in temperature, facing a contact fixed to the housing or turned away from it for use as a normally open or normally closed thermal switch, that is to say a thermal switch which, on an increase in the temperature acting on it from the outside so as to go through the snap-over temperature of the bimetal snap-action disk, goes into the turned-on or turned-off position.

As part of a preferred example of the invention, the spring snap-action disks, on being moved out of their separate resting positions go through a force minimum after a force maximum and the spring snap-action disk, responsible for the contact pressure, has a higher force maximum than the further spring snap-action disk. The maximum of the further snap-action disk is naturally made a little greater, at least, than the minimum of the first-noted spring snap-action disk responsible for the contact pressure at its force maximum.

As part of a preferred working example of the thermal switch of the invention, the disk may be part-spherical stamped or embossed round shells. However, within the framework of the invention, it is possible to have forms of the thermal switch in which the switching system, that is to say, generally speaking, the bimetal snap-action disk and the spring snap-action disks are designed as in the switch of German Offenlegungsschrift specification No. 2,917,557. The parts of the switching system may furthermore be designed in a number of different forms on the same general lines.

A form of the thermal switch of the invention needing very little space is one in which the switch is completely round and is more specially so designed that the disks have a middle opening in which a switching contact or switching head is placed. When the switching head may be fixedly joined to the disks, it is, on the other hand, possible, as part of a preferred form of the invention, for an inner opposite support or rest for the disks on the switching head to be in the form of at least one collar or ring-like shoulder. In this case the disks are only loosely slipped on the switching head and have their inner support point on the ring-like shoulder or on the collar on the switching head. As part of a preferred form of the invention, the switching system is placed within a housing, the spring snap-action disk which is deeper down in the housing having a smaller diameter than the other disks. In this form of the invention, it is then not necessary for the housing to have any undercut parts, this being a useful effect from the point of view of production engineering. Because of the smaller diameter of the disk which is lower down in the housing, the housing wall round its edge may be in the form of a ring-like shoulder which is used as a support or stop for the other disks. In certain given forms of the invention, the thermal switch is so designed that the spring snap-action disk, responsible for making contact, is placed on the floor of the housing, the spring snap-action disk having its outer edge resting against the floor of the housing as a support or stop and having its inner edge resting against the collar of the switching head. Furthermore, on the other side of the collar on the switching head, firstly the bimetal snap-action disk is placed and then, on top of it, the spring snap-action disk, the inner edges of the two disks resting against the switching head. Furthermore, the spring snap-action disk and the bimetal snap-action disk will have their outer edges resting against a ring-like shoulder running inwards from the outer wall of the housing's cover. More specially, the bimetal snap-action disk may have a further support, opposite to the said shoulder, for motion into the turned-on position of the switch. In this case the bimetal snap-action disk has two oppositely directed stops or rests for its outer edge so that it be responsible for switching operations in opposite directions, that is to say for turning the thermal switch on and off. If there is no second ring-like shoulder as a stop or rest, the bimetal disk will only have one stop at its outer edge and, for this reason, may only be responsible for one switching operation, generally turning off of the thermal switch. In the opposite direction, snapping of the disk will take place without driving anything, that is to say without causing any switching operation. In order, in such a case, to make it possible for the switch to be turned on by hand, there is a further preferred design inasfar as the switching head has an end or tailpiece which may be worked from the outside, the end sticking out through a hole in the lower side of the thermal switch. By pressing in the end of the switching head, the switch may then be moved back into its other switching position.

While in the prior art it has been necessary for thermal switches to have flexible wires soldered to the contacts of the switch, such wires being insulated, it may be necessary for such a thermal switch to be fixed to a printed circuitboard. In place of such soldered-on wires, as a preferred development of the thermal switch of the present invention, it is possible for one housing part to be used with cast-in, generally stiff metal terminal lugs. For producing an electrical contact therefrom with the terminal lug and the housing and with the switching system, it is possible, as part of a preferred working example of the invention, for the one terminal lug to have a further terminal lug running as far as the edge of the one housing part and contact strips bent round it. In this case, in a simple way, the electrical contact is produced on putting the cover in position in the housing and on crimping it inwards.

Further useful effects and details of the invention will be seen from the claims and the account now to be given of working examples of the invention to be seen in the figures of the drawing.

BRIEF DESCRIPTION OF THE DRAWINGS

FIG. 1 is a section through a thermal switch of the present invention switched into the position in which the contacts are separated.

FIG. 2 is a further section of the thermal switch of figure 1 with the contacts closed.

FIG. 3 is a section of a further working example of the thermal switch of the invention with the contacts opened.

FIG. 4 is a section of the switch of FIG. 3 with the contacts closed.

DETAILED DESCRIPTION

Figure 5:
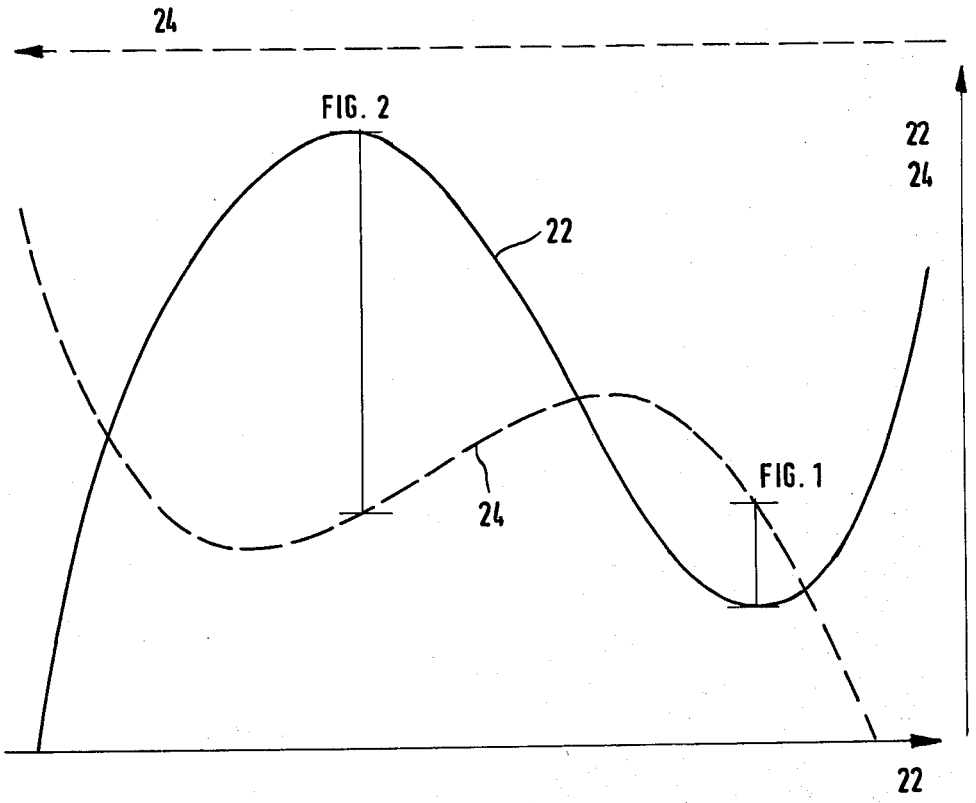
FIG. 5 is a diagrammatic graph of force against motion in the case of two snap-action disks used together in a switch of the invention.

The working example of a thermal switch generally designated by the reference numeral 10, shown in FIG. 1 has a housing 12 which will generally be made of metal, for example, brass, by turning. In housing 12 a switching system generally designated by the reference numeral 14 is placed, of which a detailed account will be given later herein. A cover 16 is fluid-tightly fixed in housing 12 and has terminal lugs 18 and 20 for electrical connection of the thermal switch.

The switching system 14 of thermal switch 10 is, in the present working example, made up of two spring snap-action disks 22 and 24 and a bimetal snap-action disk 26, which have openings by way of which they are placed, and centered on a switching head 28. The spring snap-action disks 22, 24 are pressed so as to be part-spherical in form and are placed in the switch 10 so as to have opposite effects, that is to say so as to be acting in opposite directions. Switching head 28 has a collar 30 with a ring-like shoulder, such collar being used as an inner stop and rest for the spring snap-action disks 22 and 24 and the bimetal snap-action disk 26, the spring snap-action disk 22 resting against one side of collar 30, that is to say the side thereof turned away from a switching contact 32 fixed in the housing, whereas the spring snap-action disk 24 and the bimetal snap-action disk 26 are together placed on the other side of collar 30, that is to say on the side thereof turned towards the switching contact 32 fixed in the housing. In line with this, the pushing directions of the spring snap-action disk 22 on the one hand and of the spring snap-action disk 24 together with the bimetal snap-action disk 26 against collar 30, and, for this reason, on the switching head 28, are opposite. In fact, disks 22, 24 and 26 are resting against stops on the housing for their outer edges. The outer stop or rest for the spring snap-action disk 22 is the inner floor 34 of housing 12. As an outer rest for the spring snap-action disk 24 and the bimetal snap-action disk 26 in their one switching position, use is made of a ring-like shoulder 36, running inwards over the inner edge of the housing, of cover 16. Opposite to ring-like shoulder 36, there is an upwardly running ring-like shoulder 38, forming part of the floor of the outer space within housing 12. This ring-like shoulder 38 is used as a further rest or stop for the bimetal snap-action disk 26 in its other switching condition.

Thermal switch 10 is to be seen in FIG. 1 in its one switching position, namely with the contacts open; dependent on the design and placing of the bimetal disk 26, that is to say if the side of the bimetal disk 26 with the higher rate of thermal expansion is turned towards or away from the spring snap-action disk 26 it will, in the one case, be a question of the high temperature condition of a "normally closed" thermal switch 10 while in the second case it will be a question of a "normally open" thermal switch 10. Putting it differently, in the first type of thermal switch 10, the contacts are opened on going over a certain temperature or, in the other case, they are closed.

The other switching position is to be seen in FIG. 2.

Firstly, an account will be given of the thermal switch 10 when designed as a normally open switch.

As long as the temperature is under the snap-over temperature of the bimetal snap-action disk 26, the switching system 14 will keep in the resting position of switching shown in FIG. 1. The relations between the forces of the spring snap-action disks 22 and 24 acting against each other are such that the forces of the two disks 22, 24 have the effect of generally balancing each other or the design may be such that the force of the top spring snap-action disk 24 is a little greater than the opposite force of the spring snap-action disk 22 (in this case the switching head 28 would be pushed down against the floor of the housing 12). The bimetal snap-action disk 26 has its convex side facing downwards and is not acted upon by any forces.

When the temperature goes up, the bimetal disk is bent so that its outer edge is moved against shoulder 38, it then lifts the top spring snap-action disk away from collar 30 so that the lower spring snap-action disk 22 is freed, it then lifts the switching head 28 by way of collar 30. On getting to the snapping point, the bimetal snap-action disk 26 is very quickly moved through its flat condition, pushing the top snap-action disk 24 upwards so that the lower spring snap-action disk 22 is in a position of pushing the switching head 28 upwards till it is resting against the contact 32 fixed in the housing. The switch 10 is then turned on, that is to say in the position shown in FIG. 2. To make it possible for the full force of the lower spring 22 to be able to be used for producing the contact pressure, the bimetal snap-action disk 26, in the position of FIG. 2, only has to overcome, or have the effect of balancing out, the opposite force of snap-action disk 24 which is still taking effect. Because, as described earlier, in the position of FIG. 1 the forces of the two spring snap-action disks 22 and 24 which are opposite and generally equal, that is to say balanced, the bimetal snap-action disk 26 only has to be responsible for a small force on snap-over to make the switching operation take place. The bimetal snap-action disk 26 only has to overcome the top, less powerful snap-action disk 24 in the position of FIG. 2, while the contact pressure is produced by the force of the lower, more powerful snap-action disk 22.

When the temperature goes down, the middle part of the bimetal snap-action disk 26 is moved down again and the contact force is only kept at an unchanging level by the lower spring snap-action disk 22 as long as the bimetal snap-action disk 26 has not moved down collar 30. At the snap-over point, the bimetal disk 26 is whipped downwards and overcomes—with the help of the force of the top snap-action disk 24—the force of the lower spring snap-action disk 22 so that, with the said upper spring snap-action disk 24 the bimetal disk 26 is responsible for changing over the switch back into the open position of FIG. 1.

For changing over from the open position of FIG. 1 into the closed position of FIG. 2, it will be seen from this that only a very small force, acting in the switch-closing direction, has to be produced by the bimetal snap-action disk 26 at the time of snap-over for overcoming the on-balance condition with the contacts open in FIG. 1, between the two spring snap-action disks 22, 24. In the closed condition of FIG. 2, the bimetal snap-action disk 26 only has to overcome the still acting force of the top spring snap-action disk 24 in this position so that the full spring force of the lower spring snap-action disk 22 may be used for making contact. For switching over from the turned on position of FIG. 2 into the turned-off position of FIG. 1, the bimetal snap-action disk 26 only has to overcome the difference between the oppositely acting forces of the lower spring snap-action disk 22 and the top spring snap-action disk 24 and not the full contact-closing force of the lower spring snap-action disk 22 by itself.

In place of the spring snap-action disks to be seen in the working example of FIGS. 1 and 2, whose force effects are, in all cases, opposite because of the way the have been put into position, but undergo changes in level as motion of the disks take place, it would, as a general teaching of the invention, furthermore be possible to have spring snap-action disks in the case of which at a given stage of motion there would be a change in the direction of the force produced thereby. In this case, the snap-action disks 22, 24 would have to be keyed in some way on the switching head 30 on their two sides so that it would be necessary to have at least one further ring-like shoulder.

If the bimetal snap-action disk 26 is placed the other way round in housing 12, that is to say not as in the normally open thermal switch, of which an account has been given and in which the metal side with the greater rate of thermal expansion is turned upwards, but is turned downwards, the thermal switch 10 will be a normally closed one.

An account will now be given of operation of the thermal switch, using again FIGS. 1 and 2, made up for use as a normally closed switch.

This is on the assumption that, in FIG. 2, we have the lower temperature condition of the thermal switch, that is to say the switching condition of the switch is to be seen under the switch-over temperature. The bimetal disk 26 now has its outwardly curved side facing upwards, it then, for this reason, presses against the top, less powerful spring snap-action disk 24 and lifting it to some degree so that there will be no force therefrom acting on the collar 30 of the switching head 28. For this reason, the full force of the lower spring snap-action disk 22 will be handed on by way of the collar 30 to the switching head 28 and will have the effect of forcing the head 30 against the fixed contact 32 so as to give the best possible contact force or pressure.

When the temperature goes up, the bimetal snap-action disk 26 will be moved upwards in its middle part, the contact-making pressure still being kept at the same level by the lower spring snap-action disk 22. When the temperature gets to the snap-over point, the bimetal snap-action disk 26 will be bent so that its top side becomes concave and its force, together with the force of the top snap-action disk 24 will take effect against the force of the lower spring snap-action disk 22, the forces of the top spring snap-action disk 24 and of the bimetal snap-action disk 26 at the snap-over point being greater than the force of the lower spring snap-action disk 22 so that the contacts are separated and the thermal switch goes into the position to be seen in FIG. 1.

When the temperature goes down again, the bimetal snap-action disk 26 will be snapped over, it then acting against the top spring snap-action disk 24, this unloading the lower spring snap-action disk 22 whose full force will now be used for causing contact. The switch will now be back in its turned on position of FIG. 2.

Commonly forces are such that in the turned-on position of FIG. 2 the contact-making force, produced by the spring snap-action disk 22, is equal to about 85 pounds. At the snap-over point of the bimetal snap-action disk, the top snap-action disk 24 is responsible for a force of about 40 pounds, whereas the lower snap-action disk 22 will still give a force of about 85 pounds. For this reason, the bimetal snap-action disk 26 only has to be responsible for a force of about 45 pounds for causing a change over from the turned-on position of FIG. 2 into the turned-off position of FIG. 1. In the turned-off position of FIG. 1, the two spring snap-action disks 22 and 24 will be responsible each for a force of about 30 ponds so that there will be an on-balance condition.

FIGS. 3 and 4 are views of a further working example of the thermal switch of the invention. While in the working example of FIGS. 1 and 2 on increasing and decreasing the temperature so as to go through the snap-over point of the bimetal snap-action disk 26, a switching operation was caused, the switch of FIGS. 3 and 4 is so designed that it is only turned off on going through the snap-over point of the bimetal snap-action disk 26 and there is no automatic turning on again. In fact, the switch has to be turned on by hand again. Such a switch is used as a normally closed switch, that is to say it is turned on at low temperatures and is opened on being heated through the snap-over temperature of the bimetal snap-action disk. It is, however, not turned on again simply because the temperature goes down.

Parts of the switch which are the same in function as parts of the first form of switch have the same reference numerals. For stopping the switch being turned on again, there is no ring-like shoulder 38 (see FIGS. 1 and 2) in the design of FIGS. 3 and 4 so that when the bimetal snap-action disk 26 is changed over from the condition of FIG. 3 into that of FIG. 4, that is to say into the condition in which its top side is convex, it does not come up against any stop or shoulder so that the spring snap-action disk 22 is not freed of the force, which will be the same or somewhat greater, of the spring snap-action disk 24 in the position of FIG. 3 by the bimetal snap-action disk and, for this reason, there is no switch over back from the position of FIG. 3 into the position of FIG. 4.

In fact, the resetting of the switch from the position of FIG. 3 into that of FIG. 4 has to be done by hand if needed. To this end, there is a middle opening in the floor 40 of housing 12 to let through an end 42 of switching head 28. If now the switch is to be changed over from the position of FIG. 3 into the condition of FIG. 4, end 42 is pushed inwards from the outside till the switching head 28 is moved up against the fixed contact 32 in the housing. In this position the snap-action disk 22 will be producing its greatest force and will be able to keep in this position, a condition being naturally enough, however, that the bimetal snap-action disk 26 is in the snapped position to be seen in FIG. 4.

In other respects the switching properties of the thermal switch of FIGS. 3 and 4, more specially with respect to the change over from the position of FIG. 4 into that of FIG. 3, are as noted earlier in connection with the design of FIGS. 1 and 2.

The graph of FIG. 5 illustrates in the first place the diagrammatic force-motion curves for the two spring snap-action disks 22 and 24, such two disks moving in opposite directions out of their resting or starting positions, that is to say, the resting position of the spring snap-action dis 22 is on the left in FIG. 5, while the resting or starting position of the spring snap-action disk 24 is on the right. The force curves have been so plotted as to be representative of the opposite forces when the disks 22, 24, as is in fact the case, are placed in the thermal switch 10 so as to have opposite effects or to be acting in opposite directions. Each of the spring snap-action disks 22, 24 firstly goes through a maximum (in the case of the disk 22, from the left to the right and for the disk 24, from the right to the left, the force of disk 24 being opposite and the resultant force being representative of the difference between the two forces, because the two forces have been plotted, to make things simpler and to make comparison more readily possible, in the same quadrant and then goes through a minimum. In the condition of FIG. 2 the disks are at that position designated FIG. 2 in FIG. 5. The spring snap-action disk 22 is at its force maximum and is so in a position of producing a maximum force or pressure on the contacts. The spring snap-action disk 24 is kept balanced at this time by the force opposite to this and acting in the same direction as the spring snap-action disk 22, of the bimetal snap-action disk 26. The position of FIG. 1 is, as well, marked in FIG. 5. The bimetal snap-action disk 26 is completely free at its edge (see FIG. 1), that is to say free of any forces. On changing over from the position of FIG. 2 into that of FIG. 1, the bimetal snap-action disk firstly has to make its way into a position at which, together with the force of the spring snap-action disk 24, it overcomes the opposite force of the spring snap-action disk 22 so that the switch is worked, the bimetal snap-action disk 26 then moving into its force-free condition of FIG. 1. On changing over from the position of FIG. 2 to that of FIG. 1, it is only necessary for the bimetal snap-action disk 26 to make a change in the balance of forces between the two spring snap-action disks so that the spring snap-action disk 22 is moved in the direction of its force, and then goes into its condition of FIG. 2 putting an end to the force of snap-action disk 24. The force motion curve does not have to be straight or direct but, in this case as well, may have a peak at which there is a greater force.

Figure 6:
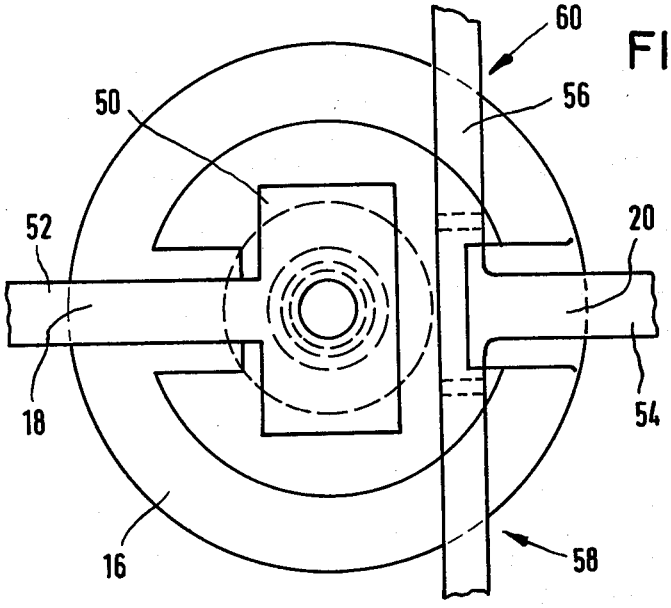
FIG. 6 is a view of a cover of a thermal switch of the invention at an early stage of making it.
Figure 7:
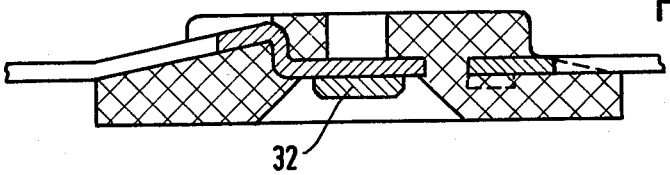
FIG. 7 is a view of the cover of FIG. 6 in section and before the terminal lugs have been bent upwards.
Figure 8:
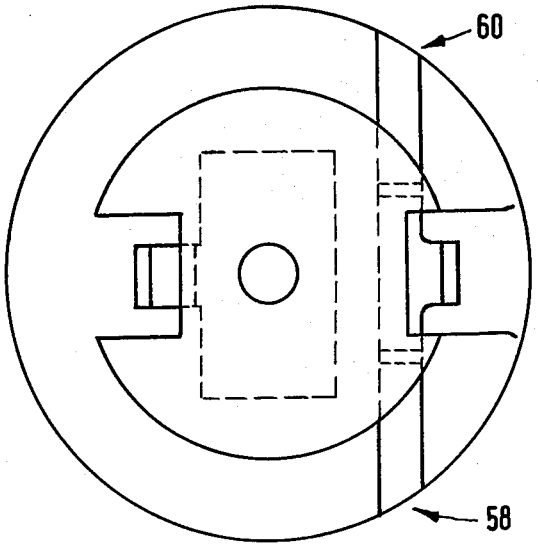
FIG. 8 is a view of the cover of FIGS. 6 and 7 in the completed condition and after the terminal lugs and contact strips have been bent upwards, looking in the same direction as in FIG. 6.

At the start of the present account of the working examples we were able to see that the cover 16 of the housing 12 of the thermal switch 10 has incast terminal lugs 18 and 20, unlike widely used terminals for thermal switches on which soldered-on connection wires are used. The terminal lugs are so designed that the terminal contact lug 18 has a middle wider part which is placed in the middle of the housing cover 16 so that it is, generally speaking, over the moving contact or switching head 28. The cover 16 is produced with a terminal tab 52 (see FIG. 6) as such running out from this middle part and away from the cover. The further terminal lug 20 is generally T-like in form, the terminal tab 54 of the terminal lug 20, like the terminal tab 52, only running out diametrally opposite to the same away from the cover 16. The end of the terminal tab 54 has its end molded into the cover, the end having terminal strips 56 running away therefrom. The terminal contact lugs 18 and 20 are molded or incast in the material of the cover 16 as may be seen in FIG. 7. The terminal lugs 18 and 20 may be part of a network for producing a number of covers 16 at the same time with their terminal lugs. In this case, after molding and curing, the terminal lugs 18 and 20 are cut to the desired lengths like the terminal strips 56. The connection tabs 52, 54 of the terminal lugs 18 and 20 are bent upwards away from the cover 16, while the terminal strips 56 are bent round the edge at 58 (and, in the other case, at 60) of the cover (see FIGS. 6 and 8). The plate-like part has a contact button 32 welded on it within the cover if desired. If now the cover 16 is placed in the housing 12 of the thermal switch 10, the middle part 50 with the welded on button 32 will take up a position over the switching head 28, while the bent over ends of the contact strips 56 will come into contact with the housing 12 itself. In the turned on position of FIG. 2 there is an electrical contact pass between the terminal lug 18 by way of the wider part 50, the button 32 to the moving switching head 28, from the same by way of the spring snap-action disk 22 to the housing 12 and by way of the ends of the contact strips 56 to the terminal tab 52 of the terminal lug 20.

While the account of the invention has been limited to working examples of thermal switches 10 with a round housing 12 and round snap-action disks 22, 24, other forms of the invention would be possible, for example, ones in which the spring snap-action disks are not round but are longer in one direction than in an other and it would furthermore be possible to have bimetal snap-action disks 26 which are cut back at their edges, such a design using a rectangular housing which is longer than it is broad. In this case, for example, the terminal parts or lugs might be designed so as to run or extend out from the side to the housing 12.

I claim:

1. A thermal switch comprising a bimetal snap action disk means for carrying out a switching operation, electrical contacts, at least one first snap action disk means associated with said bimetal snap action disk means for ensuring a sufficient force application between the electrical contacts of the switch when the switch is in a closed position to thereby enable the bimetal snap action disk means to only carry out the actual switching operation, a second spring snap action disk means associated with said bimetal snap action disk means and said first spring snap action disk means, said first and second spring snap disk means are in the form of two pre-embossed spring members, said first and second spring action disk means being arranged such that respective spring forces thereof generated during a displacement from a normal rest position are, at least at a switching point of the bimetal snap action disk means, directed in opposition to each other, whereby the bimetal snap action disk means need only overcome a difference in the spring forces of the first and second snap action disk means with at least a whole force of said first spring snap action disk means being effective as a pressure force for the switch in the closed position.

2. The thermal switch as claimed in claim 1, wherein each spring snap action disk means are pre-embossed by being bent out of an equilibrium condition so as to provide for a force opposite to such bending force, going through a maximum and then through a minimum, said second spring snap action disk means being weaker and producing a maximum opposite force greater than a maximum force of said first spring snap action disk means responsible for forcing said electrical contacts together.

3. The thermal switch as claimed in one of claims 1 or 2, wherein the spring snap action disks are part-spherical round shell-like structures.

4. The thermal switch as claimed in claim 2, further comprising a switching head with one of said electrical contacts provided at one end thereof, said switching head being positioned in central openings in said bimetal disk means and said first and second spring snap action disk means.

5. The thermal switch as claimed in claim 4 wherein said switching head has at least one ring-like shoulder thereon against which inner limits of said central openings are rested.

6. A thermal switch having a bimetal snap action disk, electrical contacts, and two formed spring snap action disks, said two spring snap action disks being placed so as to be responsible for forces acting in opposite directions, each spring snap action disk, on being bent out of an equilibrium condition thereof is responsible for a force, opposite to such bending force, going through a maximum and then through a minimum, one of said spring snap action disks being weaker and producing an opposite force maximum greater than the maximum force of said other spring snap action disk which is responsible for forcing said contacts together, a switching head with one of said contacts at one end thereof, said head being positioned in middle openings in said bimetal disk and said spring snap action disks, said head has at least one ring-like shoulder thereon against which inner limits of said disk openings are rested, said ring-like shoulder on said head is on one side of a collar on said head, said bimetal snap action disk being placed on one side of said collar with said weaker snap action disk, while the other spring snap action disk is on the other side of said collar.

7. The thermal switch as claimed in claim 5, having an outer rest for outer edges of said first and second snap action disk means, said outer rest being lined up with said ring-like shoulder on said switching head.

8. The thermal switch as claimed in claim 7, having a housing in which said first and second snap action disk means are placed with one of said contacts fixed to said housing on one side of the snap action disk means, the snap action disk means which is furtherest from said contact being smaller in diameter than the other snap action disk means.

9. The thermal switch as claimed in claim 8, wherein said snap action disk means with said smaller diameter is next to a floor part of said housing with an outer edge thereof resting agains an outer limit of said floor as a support and with the limit of the central opening of said smaller-diameter disk resting against said collar on said switching head, whereas on the other side of said collar the bimetal snap action disk means and the other said spring snap action disk means are placed with limits on their central openings resting against said other side of said collar, said bimetal disk means being placed between the two said spring snap action disk means, said housing further having a cover with a ring-like shoulder facing into the inside of the housing and within an outer wall of said housing, said ring-like shoulder of said cover taking the form of a rest or support for outer edges of said bimetal disk means and said spring snap action disk means next thereto.

10. The thermal switch as claimed in one of claims 4, 5 or 6, wherein said switch head has an end button thereon which is adapted to be operated from outside the switch for enabling an operation of said switch.

11. The thermal switch as claimed in claim 9, having a further rest facing said ring-like shoulder of said cover, said further rest supporting an outer edge of said bimetal disk for motion thereof into a turned-on condition of said switch.

12. The thermal switch as claimed in one of claims 1 or 2, having a housing part of insulating material with relatively stiff thermal lugs molded therein.

13. The thermal switch as claimed in claim 1, further comprising a housing part of an insulating material with relatively stiff terminal lugs molded therein, said switch further including a thermal contact with an inner end, and having a switching head adapted to be switchingly moved by said first and second disk means up to and away from said inner end.

14. The thermal switch as claimed in claim 13, having a further contact lug running as far as an edge of a housing part and having a contact strip bent round said housing part.

15. The thermal switch as claimed in claim 14, having connection tags joined up with the connection contacts and running parallel to each other outwardly away from said housing parts.

16. A thermal switch comprising:

a housing, two aligned concave disks within said housing, a switching head joining said disks at central portions thereof and being adapted to be moved by said disks, said head having a contact face thereon at one end thereof, said disks being responsible for generating opposing forces, said forces changing in a level on a bending of said two disks along a line normal to said disks so as to give two equilibrium positions of said switching head, and a bimetal disk interposed between said two disks and connected to said switching head for causing a snapping motion of said two disks in at least one direction.

17. The switch as claimed in claim 16, wherein said disks taken separately are each designed for producing a force in a single direction and each have a single equilibrium position.

* * * * *